US006505951B1

(12) United States Patent
Lorenzo, Jr. et al.

(10) Patent No.: US 6,505,951 B1
(45) Date of Patent: Jan. 14, 2003

(54) WALL-MOUNTABLE, BATTERY-OPERATED LIGHT-EMITTING DEVICE

(76) Inventors: Mauricio H. Lorenzo, Jr., 11211 Andy Dr., Riverview, FL (US) 33569; Michelle A. Lorenzo, 11211 Andy Dr., Riverview, FL (US) 33569

( * ) Notice: Subject to any disclaimer, the term of this patent is extended or adjusted under 35 U.S.C. 154(b) by 0 days.

(21) Appl. No.: 10/015,183

(22) Filed: Nov. 19, 2001

Related U.S. Application Data

(63) Continuation-in-part of application No. 09/415,002, filed on Oct. 8, 1999.

(51) Int. Cl.[7] ..... F21L 4/02; F21V 33/00

(52) U.S. Cl. ..... 362/184; 362/183; 362/186; 362/147; 362/233; 340/825.22

(58) Field of Search ..... 362/184, 183, 362/186, 310, 147, 230, 231, 233; 340/825.22, 310; 315/291, 292

(56) References Cited

U.S. PATENT DOCUMENTS

| | | | | |
|---|---|---|---|---|
| 3,475,603 A | | 10/1969 | Gheno | |
| 4,418,333 A | | 11/1983 | Schwarzbach et al. | |
| 4,649,323 A | | 3/1987 | Pearlman et al. | |
| 4,740,872 A | * | 4/1988 | Chou | 362/183 |
| 5,189,412 A | * | 2/1993 | Mehta et al. | 340/310.01 |
| 5,463,286 A | | 10/1995 | D'Aleo et al. | |
| D367,725 S | | 3/1996 | Segill et al. | |
| 5,521,595 A | * | 5/1996 | Totten et al. | 340/321 |
| 5,727,868 A | | 3/1998 | Sharma | |
| 5,810,193 A | | 9/1998 | Gordon | |
| 5,969,627 A | * | 10/1999 | Tarlton et al. | 340/384.1 |

* cited by examiner

*Primary Examiner*—Sandra O'Shea
*Assistant Examiner*—Ali Alavi

(57) ABSTRACT

A battery-operated light-emitting device including a housing having two battery-receiving ports extending in the housing. A light is mounted on the housing. A power source is connected to the light and includes a removable battery, and a battery charging device for charging the battery. A central processing unit is connected to the battery connectors and the light. A receiver is mounted on the housing and is connected to the central processing unit. A remote transmitter is provided for sending signals to the receiver, and a multiple signal selector switch is mounted to the housing and is connected to the central processing unit for allowing a particular signal to be received from the transmitter for energizing the light. An interchangeable cover removably mounts on the housing when the housing is in a mounted condition on a wall.

7 Claims, 4 Drawing Sheets

FIG 3
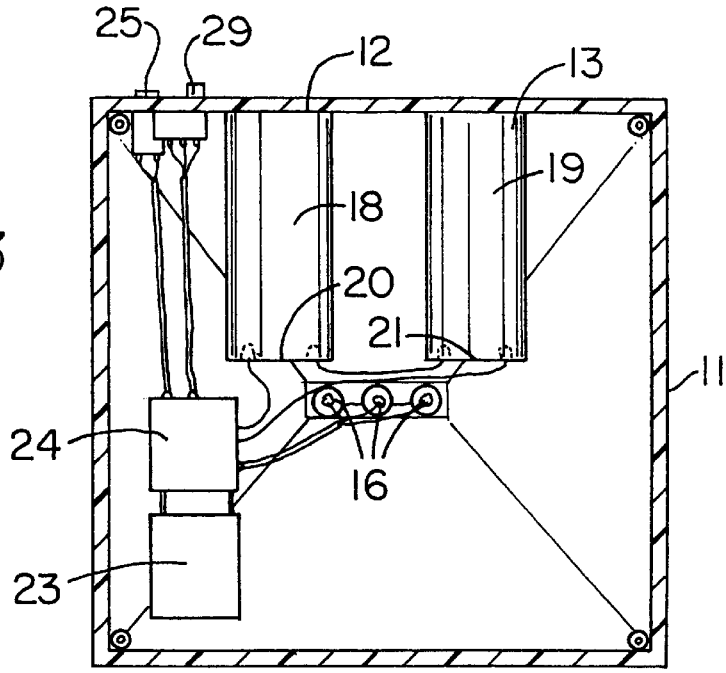
FIG 4
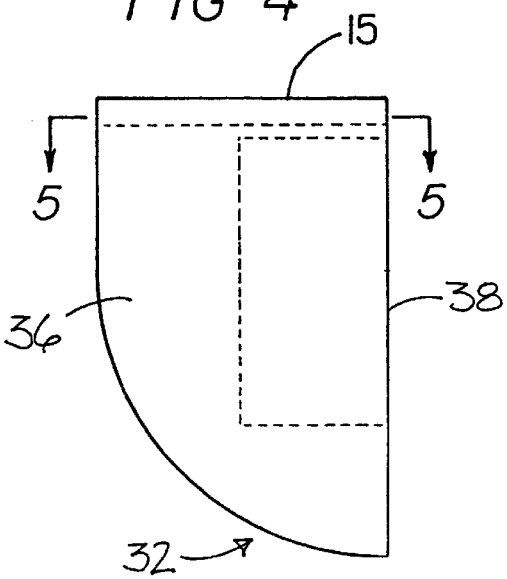
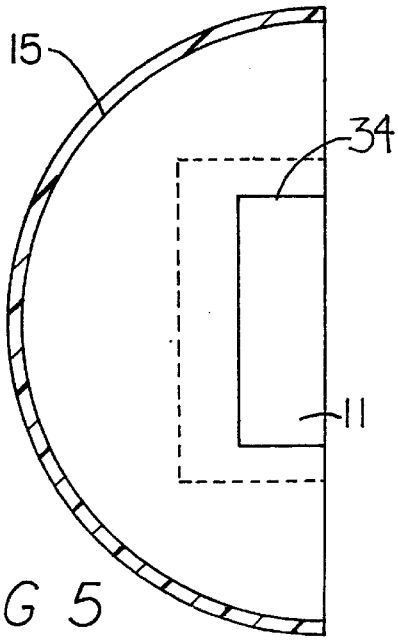
FIG 5

WALL-MOUNTABLE, BATTERY-OPERATED LIGHT-EMITTING DEVICE

REFERENCE TO RELATED APPLICATION

This application is a continuation-in-part of application Ser. No. 09/415,002, filed Oct. 8, 1999.

BACKGROUND OF THE INVENTION

1. Field of the Invention

The present invention relates to remote controlled light-emitting device and more particularly pertains to a new battery-operated light-emitting device for providing a new type of residential lighting device.

2. Description of the Prior Art

The use of remote controlled light-emitting device is known in the prior art. More specifically, remote controlled light-emitting device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,727,868; U.S. Pat. No. 3,475,603; U.S. Pat. No. 5,189,412; U.S. Pat. No. 5,810,193; U.S. Pat. No. 4,418,333; and U.S. Pat. No. Des. 367,725.

While these devices fulfill their respective, particular objectives and requirements, the aforementioned patents do not disclose a new battery-operated light-emitting device. The inventive device includes a housing having two battery-receiving ports extending in the housing which includes a transparent side and a transparent cover which is removeably mounted over the transparent side. A light-emitting means is securely mounted inside the housing. A power source is connected to the light-emitting means and includes batteries and battery connectors disposed inside the battery-receiving ports and further includes a battery charging member for charging the batteries. A central processing unit is connected to the battery connectors and is securely mounted inside the housing and also is connected to the light-emitting means. A radio receiver is securely mounted inside the housing and is connected to the central processing unit. An on/off switch for energizing the central processing unit and the light-emitting means is mounted to the housing. A remote radio transmitter is used for sending signals to the radio receiver, and a multiple signal selector switch is securely mounted to the housing and is connected to the central processing unit for allowing a particular signal to be received from the radio transmitter for energizing the light-emitting means.

In these respects, the battery-operated light-emitting device according to the present invention substantially departs from the conventional concepts and designs of the prior art, and in so doing provides an apparatus primarily developed for the purpose of providing a new type of residential lighting device.

SUMMARY OF THE INVENTION

In view of the foregoing disadvantages inherent in the known types of remote controlled light-emitting device now present in the prior art, the present invention provides a new battery-operated light-emitting device construction wherein the same can be utilized for providing a new type of residential lighting device.

The general purpose of the present invention, which will be described subsequently in greater detail, is to provide a new battery-operated light-emitting device which has many of the advantages of the remote controlled light-emitting device mentioned heretofore and many novel features that result in a new battery-operated light-emitting device which is not anticipated, rendered obvious, suggested, or even implied by any of the prior art remote controlled light-emitting device, either alone or in any combination thereof.

To attain this, the present invention generally comprises a housing having two battery-receiving ports extending in the housing which includes a transparent side and a transparent cover which is removeably mounted over the transparent side. A light-emitting means is securely mounted inside the housing. A power source is connected to the light-emitting means and includes batteries and battery connectors disposed inside the battery-receiving ports and further includes a battery charging member for charging the batteries. A central processing unit is connected to the battery connectors and is securely mounted inside the housing and also is connected to the light-emitting means. A radio receiver is securely mounted inside the housing and is connected to the central processing unit. An on/off switch for energizing the central processing unit and the light-emitting means is mounted to the housing. A remote radio transmitter is used for sending signals to the radio receiver, and a multiple signal selector switch is securely mounted to the housing and is connected to the central processing unit for allowing a particular signal to be received from the radio transmitter for energizing the light-emitting means There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new battery-operated light-emitting device which has many of the advantages of the remote controlled light-emitting device mentioned heretofore and many novel features that result in a new battery-operated light-emitting device which is not anticipated, rendered obvious, suggested, or even implied by any of the prior art remote controlled light-emitting device, either alone or in any combination thereof.

It is another object of the present invention to provide a new battery-operated light-emitting device which may be easily and efficiently manufactured and marketed.

It is a further object of the present invention to provide a new battery-operated light-emitting device which is of a durable and reliable construction.

An even further object of the present invention is to provide a new battery-operated light-emitting device which is susceptible of a low cost of manufacture with regard to both materials and labor, and which accordingly is then susceptible of low prices of sale to the consuming public, thereby making such battery-operated light-emitting device economically available to the buying public.

Still yet another object of the present invention is to provide a new battery-operated light-emitting device which provides in the apparatuses and methods of the prior art some of the advantages thereof, while simultaneously overcoming some of the disadvantages normally associated therewith.

Still another object of the present invention is to provide a new battery-operated light-emitting device for providing a new type of residential lighting device.

Yet another object of the present invention is to provide a new battery-operated light-emitting device which includes a housing having two battery-receiving ports extending in the housing which includes a transparent side and a transparent cover which is removeably mounted over the transparent side. A light-emitting means is securely mounted inside the housing. A power source is connected to the light-emitting means and includes batteries and battery connectors disposed inside the battery-receiving ports and further includes a battery charging member for charging the batteries. A central processing unit is connected to the battery connectors and is securely mounted inside the housing and also is connected to the light-emitting means. A radio receiver is securely mounted inside the housing and is connected to the central processing unit. An on/off switch for energizing the central processing unit and the light-emitting means is mounted to the housing. A remote radio transmitter is used for sending signals to the radio receiver, and a multiple signal selector switch is securely mounted to the housing and is connected to the central processing unit for allowing a particular signal to be received from the radio transmitter for energizing the light-emitting means.

Still yet another object of the present invention is to provide a new battery-operated light-emitting device that is easy to install and operate.

Even still another object of the present invention is to provide a new battery-operated light-emitting device that has an attractive appearance and is reliable.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional side elevational view of the present invention.

FIG. 4 is a partial side elevational view of the present invention.

FIG. 5 is a top plan view of the present invention.

DESCRIPTION OF THE PREFERRED EMBODIMENT

Figure 1:
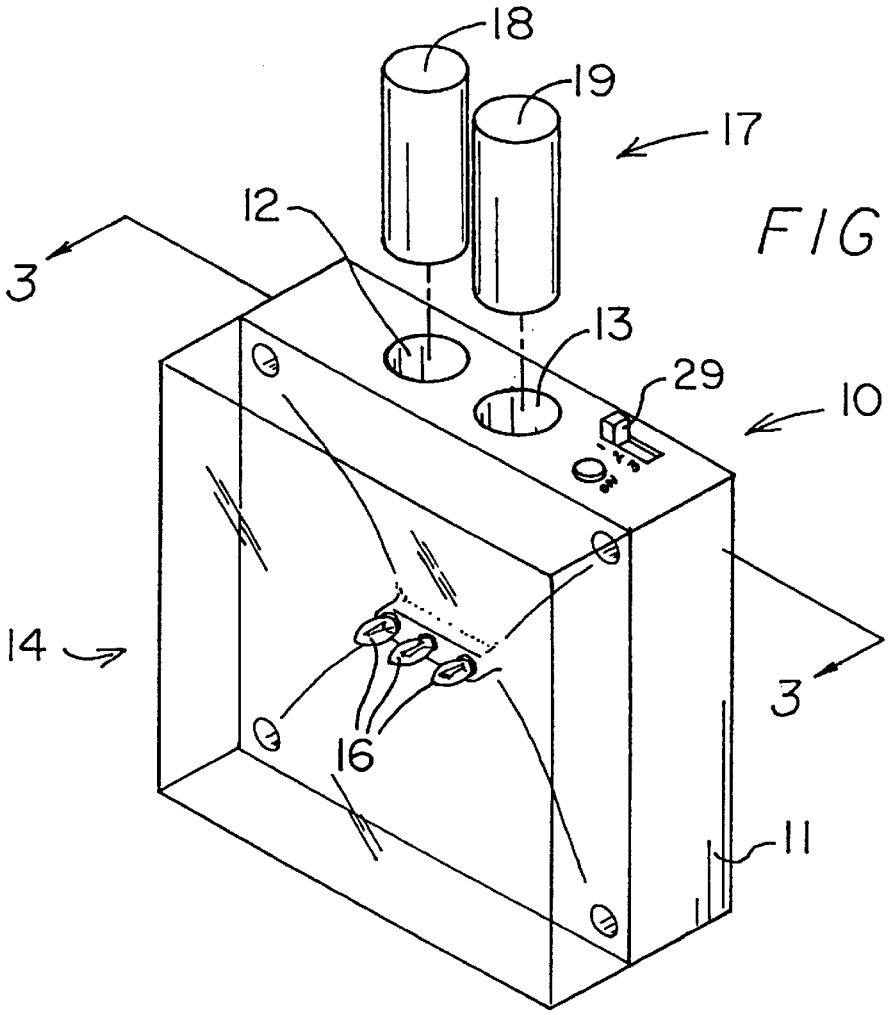
FIG. 1 is a perspective view of a new battery-operated light-emitting device According to the present invention.
Figure 2:
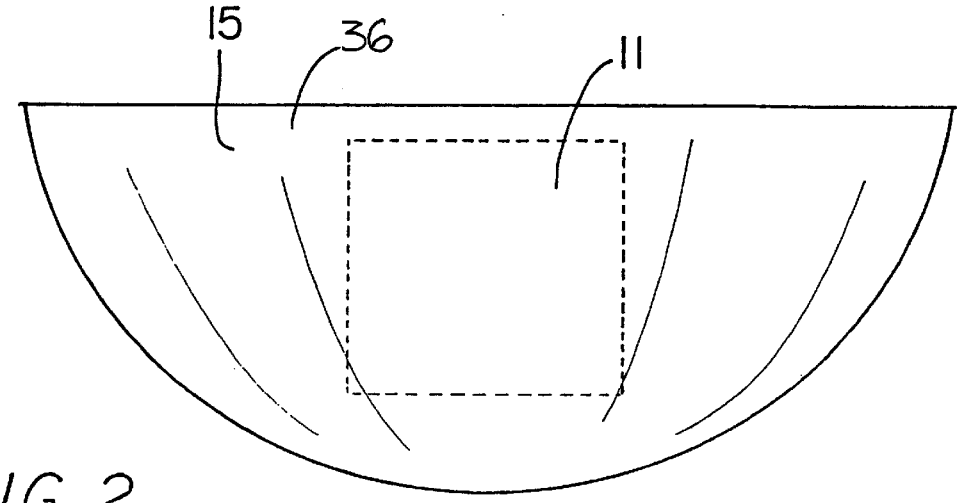
FIG. 2 is a front view of the present invention with the transparent cover.
Figure 6:
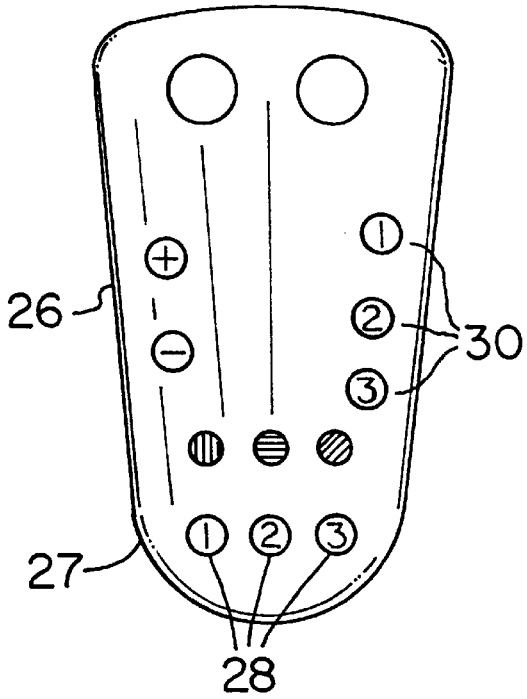
FIG. 6 is a top plan view of the remote radio transmitter of the present invention.
Figure 7:
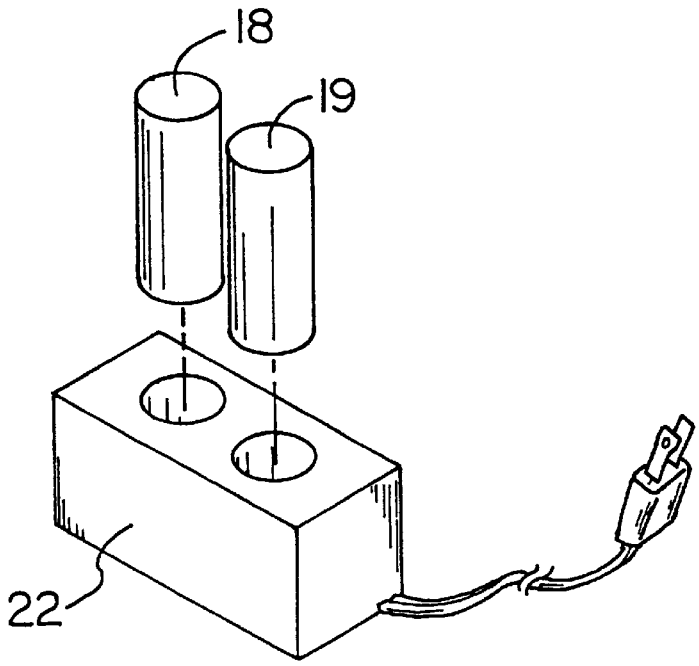
FIG. 7 is perspective view of the batteries and battery charging member of the present invention.
Figure 8:
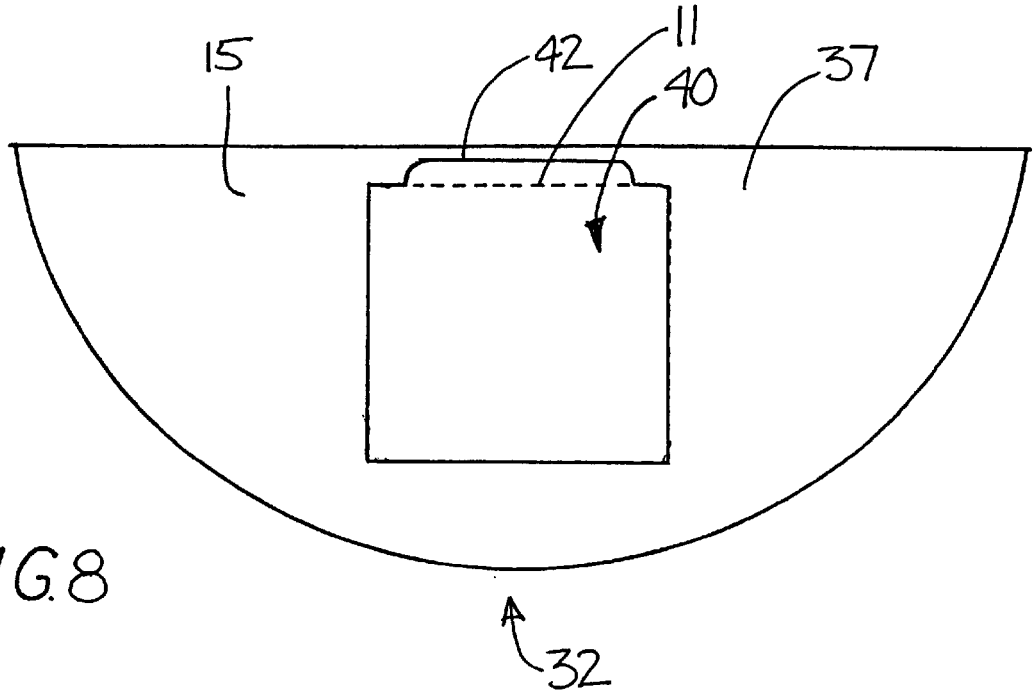
FIG. 8 is a rear view of the transparent cover of the present invention.

With reference now to the drawings, and in particular to FIGS. 1 through 8 thereof, a new battery-operated light-emitting device embodying the principles and concepts of the present invention and generally designated by the reference numeral 10 will be described.

As best illustrated in FIGS. 1 through 8, the battery-operated light-emitting device 10 generally comprises a housing means including a housing 11. Two battery-receiving ports 12, 13 extend in the housing 11 which includes a transparent side 14 and which is generally a square. An interchangeable cover 15 is removeably mounted over the transparent side 14. A light-emitting means 16 is securely and conventionally mounted inside the housing means for emitting a light through the transparent side 14 and through the transparent cover 15. A power source 17 is connected with wires to the light-emitting means 16 and includes two batteries 18, 19 and two sets of battery connectors 20, 21 which are disposed inside the battery-receiving ports 12, 13 of the housing 11 and further includes a battery charging member 22 for charging the batteries 18, 19 which are removeably received in the battery-receiving ports 12, 13. For controlling and energizing the light-emitting means 16, a central processing unit 24 is connected to the battery connectors 20, 21 and is securely mounted inside the housing 11 and also is connected to the light-emitting means 16 with wires. A radio receiver 23 is securely mounted inside the housing 11 and is connected with wires to the central processing unit 24. An on/off switch 25 for energizing the central processing unit 24 and the light-emitting means 16 is securely mounted to a wall of the housing 11. A remote radio transmitter 26 for sending signals to the radio receiver 23 is used to turn on and off the light-emitting means 16 and a multiple signal selector switch 29 is securely mounted to a wall of the housing 11 and is connected to the central processing unit 24 for allowing a particular signal to be received from the radio transmitter 26 for energizing the light-emitting means 16. The remote radio transmitter 26 includes a housing member 27 and is capable of transmitting multiple signals and further includes a signal transmitting selector switch 28 securely mounted to the housing member 27 for transmitting a selected signal to the radio receiver 23, and also includes a timer means 30 having a plurality of timer buttons disposed upon the housing member 27 for selecting the amount of time for the light-emitting means is to be energized. Optionally, a dimmer means may be included in the control circuitry to permit the user to be able to adjust and set the relatively brightness of the light emitted by the light-emitting means.

One particularly significant aspect of the present invention is the interchangeable cover 15 that is capable of being removably mounted on the housing 11 when the housing is in a mounted condition on a wall. The interchangeable cover 15 has a closed bottom 32 for covering the housing from view. The interchangeable cover 15 has an open top 34 for permitting access to the battery-receiving port in the upper wall of the housing. The interchangeable cover has a front wall 36 and a rear wall 38. The rear wall 38 of the interchangeable cover may have an opening 40 formed therein that extends into a cavity of channel formed in the interchangeable cover, and the channel removably receives a portion of the housing 11 therein such that the housing 11 supports the interchangeable cover 15 when the portion of the housing is inserted into the opening 40. The opening 40 may have a cutout portion 42 extending into the rear wall for providing clearance for the battery 18, 19 when the portion of the housing is moved through the opening 40. The front 36 and rear 38 walls may be united along lower edges of the front and rear walls. The front wall of the cover may have a shape defining a portion of a spherical shape, and the rear wall may be substantially planar and have a periphery defining a portion of a circle.

In use, the wall-mountable, battery-operated light-emitting device 10 can be mounted to a desirable wall location and if the user has several of these devices, the user can set the multiple signal selector switch 29 to a particular channel for receiving a particular radio transmission from the radio transmitter 26. Using the remote radio transmitter 26, the user can turn on or off the light-emitting means 16 as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A wall mountable, battery-operated light-emitting apparatus comprising:

a housing having at least one battery-receiving port formed therein, said at least one battery-receiving port extending in said housing, wherein said at least one battery-receiving port is located on an upper wall of said housing for permitting battery removal and replacement in an upward direction from said housing;

a light-transmitting lens removably mounted on said housing;

a light mounted on said housing in a location between said housing and said light transmitting lens for emitting light through said light-transmitting lens;

a power source connected to said light, said power source including at least one battery removably received in said at least one battery-receiving port and at least one set of battery connectors being disposed inside said at least one battery-receiving port of said housing, said at least one battery being rechargeable;

a battery charging device for charging said at least one battery, said battery charging device having at least one battery port for removably receiving said at least one battery when said at least one battery is not received in said at least one battery portion of said housing; and an interchangeable cover for removably mounting on said housing when said housing is in a mounted condition on a wall, said interchangeable cover having a closed bottom for covering said housing from view, said interchangeable cover having an open top for permitting access to the battery-receiving port in the upper wall of said housing, said interchangeable cover having a front wall and a rear wall, said rear wall of said interchangeable cover having an opening formed therein for removably receiving a portion of said housing therein such that said housing supports said interchangeable cover when the portion of said housing is inserted into said opening.

2. The apparatus of claim 1 wherein said opening in said rear wall of said interchangeable cover has a cutout portion extending into said rear wall for providing clearance for said at least one battery when the portion of said housing is moved through said opening.

3. The apparatus of claim 1 wherein said front and rear walls of said interchangeable cover are united along lower edges of said front and rear walls.

4. The apparatus of claim 1 wherein said front wall has a shape defining a portion of a spherical shape, and said rear wall is substantially planar and having a periphery defining a portion of a circle.

5. The apparatus of claim 1 additionally comprising a means for controlling and energizing said light.

6. The apparatus of claim 5 wherein said means comprises a central processing unit connected to said at least one set of battery connectors and being mounted inside said housing, said central processing unit also being connected to said light;

a receiver mounted on said housing and being connected to said central processing unit;

an on/off switch for energizing said central processing unit and said light, said on/off switch being mounted on said housing;

a remote transmitter for sending signals to said receiver, said remote transmitter including a portable housing, said remote transmitter being capable of transmitting multiple signals, said remote transmitter including a signal transmitting selector switch mounted on said portable housing for transmitting a selected signal to said receiver, said remote transmitter also including a timer for selecting the amount of time said light-emitter is to be energized; and a multiple signal selector switch mounted on a top wall of said housing and being connected to said central processing unit for allowing a particular signal to be received from said remote transmitter for causing energizing of said light.

7. A wall mountable, battery-operated light-emitting apparatus comprising:

a housing having at least one battery-receiving port formed therein, said at least one battery-receiving port extending in said housing, wherein said at least one battery-receiving port is located on an upper wall of said housing for permitting battery removal and replacement in an upward direction from said housing;

a light-transmitting lens removably mounted on said housing;

a light mounted on said housing in a location between said housing and said light transmitting lens for emitting light through said light-transmitting lens;

a power source connected to said light, said power source including at least one battery removably received in said at least one battery-receiving port and at least one set of battery connectors being disposed inside said at least one battery-receiving port of said housing, said at least one battery being rechargeable;

a battery charging device for charging said at least one battery, said battery charging device having at least one battery port for removably receiving said at least one battery when said at least one battery is not received in said at least one battery portion of said housing; and a means for controlling and energizing said light including:

a central processing unit connected to said at least one set of battery connectors and being mounted inside said housing, said central processing unit also being connected to said light;

a receiver mounted on said housing and being connected to said central processing unit;

an on/off switch for energizing said central processing unit and said light, said on/off switch being mounted on said housing;

a remote transmitter for sending signals to said receiver, said remote transmitter including a portable housing, said remote transmitter being capable of transmitting multiple signals, said remote transmitter including a signal transmitting selector switch mounted on said portable housing for transmitting a selected signal to said receiver, said remote transmitter also including a timer for selecting the amount of time said light-emitter is to be energized;

a multiple signal selector switch mounted on a top wall of said housing and being connected to said central processing unit for allowing a particular signal to be received from said remote transmitter for causing energizing of said light;

an interchangeable cover for removably mounting on said housing when said housing is in a mounted condition on a wall, said interchangeable cover having a closed bottom for covering said housing from view, said interchangeable cover having an open top for permitting access to the battery-receiving port in the upper wall of said housing, said interchangeable cover having a front wall and a rear wall, said rear wall of said interchangeable cover having an opening formed therein for removably receiving a portion of said housing therein such that said housing supports said interchangeable cover when the portion of said housing is inserted into said opening, said opening having a cutout portion extending into said rear wall for providing clearance for said at least one battery when the portion of said housing is moved through said opening, said front and rear walls being united along lower edges of said front and rear walls, said front wall having a shape defining a portion of a spherical shape, said rear wall being substantially planar and having a periphery defining a portion of a circle.

* * * * *